United States Patent [19]

Cecchetti

[11] 3,931,970

[45] Jan. 13, 1976

[54] PLASTIC GAME BOARD HAVING A UNITARY FRAME

[75] Inventor: Claudio Cecchetti, Milan, Italy

[73] Assignee: Arco Falc srl, Milan, Italy

[22] Filed: Apr. 23, 1975

[21] Appl. No.: 570,594

Related U.S. Application Data

[63] Continuation of Ser. No. 432,864, Jan. 14, 1974, abandoned.

[52] U.S. Cl. ..... 273/85 D; 273/834

[51] Int. Cl.[2] ..... A63F 7/06

[58] Field of Search ..... 46/27, 28; 273/85, 94, 273/DIG. 26

[56] References Cited

UNITED STATES PATENTS

| | | | |
|---|---|---|---|
| 2,264,492 | 12/1941 | Weaver | 273/DIG. 26 |
| 3,424,365 | 1/1969 | Venturi | 46/28 |
| 3,480,277 | 11/1969 | Fraser | 273/85 D |
| 3,724,851 | 4/1973 | Cecchetti | 273/85 D |
| 3,781,010 | 12/1973 | Matsumoto | 273/85 C |

*Primary Examiner*—Anton O. Oechsle
*Assistant Examiner*—Marvin Siskind
*Attorney, Agent, or Firm*—Thomas L. Tully; Arthur A. Johnson

[57] ABSTRACT

A game board for use with one or more movable game pieces comprising a playing surface board, a rectangular plastic frame providing a walled element around said playing surface board for substantially confining the game piece thereon and a base board spaced beneath the playing field board. The plastic frame is a unitary structure having a generally inverted U-shaped cross-section and comprising downwardly spaced inner and outer walls connected by a top surface. The playing surface board is attached adjacent the base of the inner wall and the base board is on a plane beneath the playing field board and is attached adjacent the base of the outer wall, to provide a strong, rigid game board having a streamlined appearance.

8 Claims, 6 Drawing Figures

PLASTIC GAME BOARD HAVING A UNITARY FRAME

This is a continuation of application Ser. No. 432,864 filed Jan. 14, 1974, and now abandoned.

The present invention relates to novel improved game boards, particularly to those for use in action-type games in which one or more game pieces are vigorously played over a playing surface in an attempt to make a score and/or to prevent an opponent from making a score. Such games include soccer, hockey, basketball, pinball, bowling, and many others.

Prior game boards have generally been constructed with frames of wood, fiberboard, plastic, sheet metal or combinations thereof. Wooden frames are heavy, require much labor to produce and assemble and are susceptible to cracking, loosening and coming apart during vigorous use. Fiberboard frames are relatively weak and tend to warp, loosen and come apart during vigorous use. Plastic frames are quite flexible and tend to separate from the rigid playing field board during vigorous use, and sheet metal frames generally are also so flexible and weak as to present problems with respect to warping and detachment during vigorous use.

It is the principal object of the present invention to provide a novel game board structure which is exceptionally strong, rigid and resistant to detachment even under conditions of vigorous use.

It is another object of this invention to provide a novel game board having an injection-molded unitary plastic frame which has greater strength and rigidity than prior known plastic frames and which is provided with increased strength and rigidity by spaced attachment to a playing field board and an underlying base board.

It is still another object of this invention to provide a novel game board structure having a unitary plastic frame comprising spaced walls which provide a housing which is functional in connection with one or more features of the game.

These and other objects and advantages of the present invention will be apparent to those skilled in the art in the light of the present disclosure including the drawings which represent a preferred but not limitative embodiment, in which.

Figure 1:
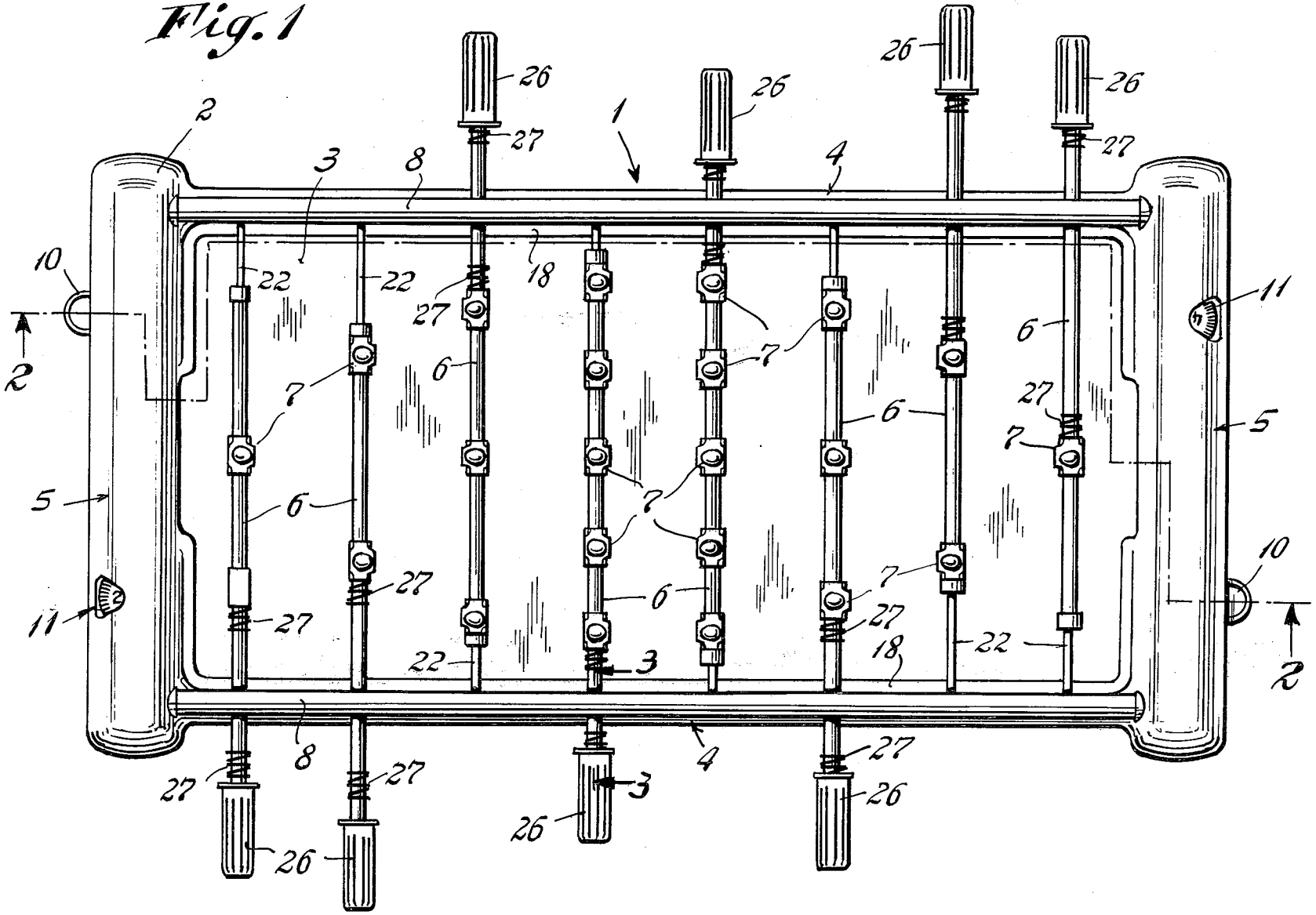
FIG. 1 is a plan view of a game board according to one embodiment of the present invention.

Referring to the drawings, FIG. 1 illustrates a game board 1 comprising a frame 2 which is generally rectangular and which provides a walled element around a playing surface board 3 which is attached to the frame. The frame 2 is a unitary structure having side members 4 and end members 5.

In the embodiment illustrated, the side members 4 of the frame 2 support game piece-activating bars 6 having spaced simulated miniature soccer players 7 fixed thereto and adapted to contact a miniature soccer ball on the surface of the playing field board when the bars 6 are telescoped in or out to align a soccer player 7 with the ball and bar 6 is rotated to pivot soccer player 7 into contact with the ball. Plastic flexible retainer strips 8 are removably attached at the top surface 9 of the side members 4 to retain the bars 6 in position. Also, in the embodiment illustrated, the end members 5 of the frame 2 provide a housing for a ball return element 10 and for a score dial 11.

Figures 2, 3, 4, 5, 6:
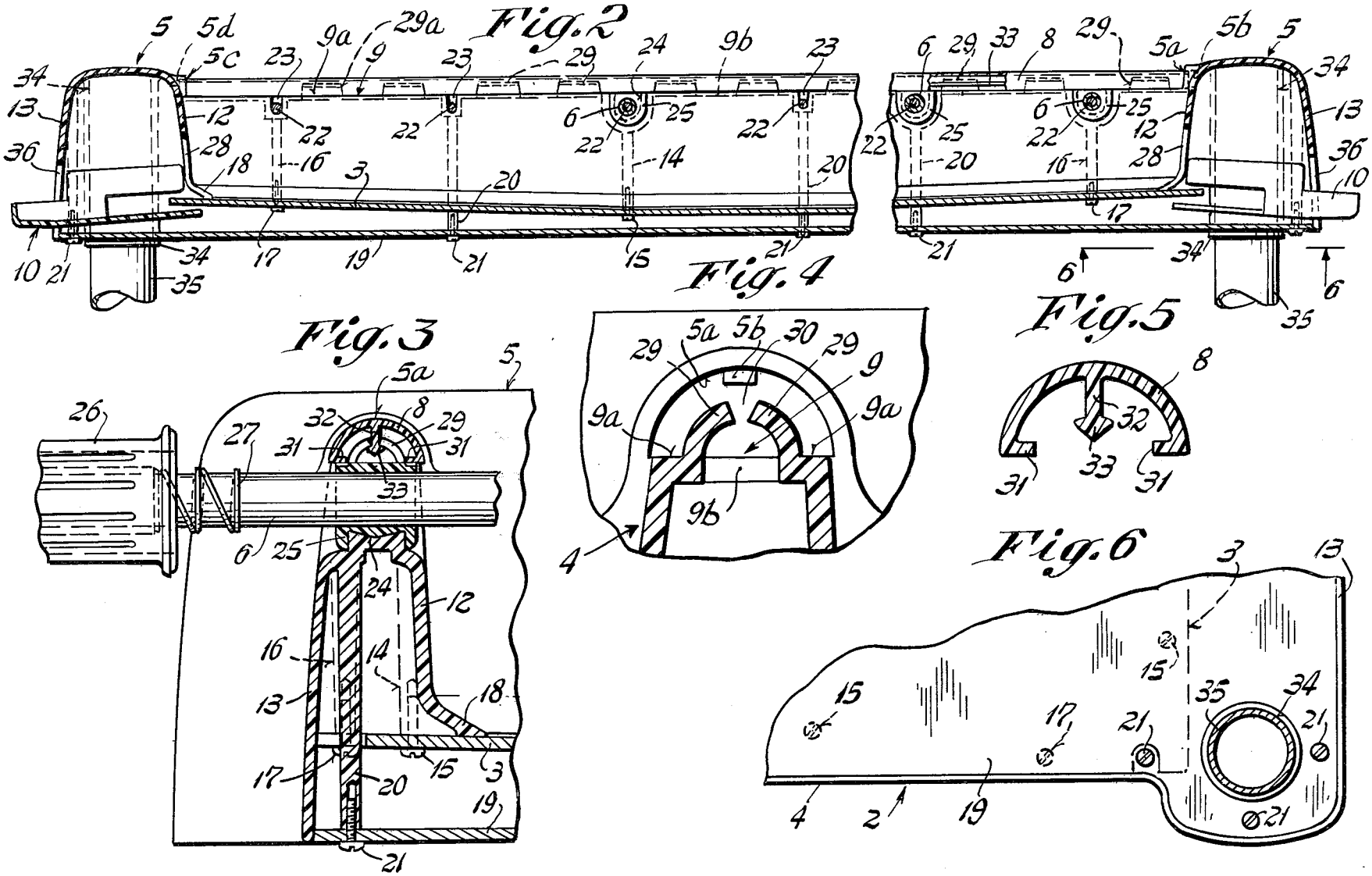
FIG. 2 is a sectional side view taken along the line 2—2 of the game board of FIG. 1.
FIG. 3 is a sectional view of a side of the frame supporting a game piece-activating bar, taken along the line 3—3 of FIG. 1.
FIG. 4 is a sectional end view of a portion of the top surface of a side of the frame, with the retainer strip removed for purposes of illustration.
FIG. 5 is a sectional end view of a retainer strip adapted to engage the top surface of the frame illustrated by FIG. 4.
FIG. 6 is a bottom view of a corner section of the present game board, taken along the line 6—6 of FIG. 2.

Referring to FIGS. 2 and 3 of the drawings, the frame 2 has a generally inverted U-shaped cross-section and comprises downwardly spaced inner wall 12 and outer wall 13 connected by a top surface 9. The playing surface board 3 is attached to holed support members 14 adjacent the base of the inner wall by means of screws 15 and is also attached to holed support members 16 adjacent the outer wall 13 by means of screws 17. The base 18 of the inner wall 12 is inclined or tapered laterally to the surface of the playing surface board 3, as shown in FIG. 3, and is also inclined or tapered longitudinally towards the center of the game board, as shown in FIG. 2, so that the attached playing surface board is inclined from each end to the center to cause the free-moving game piece to move to the center of the playing surface.

The game is also provided with a base board 19 on a plane beneath the playing surface board 3, base board 19 being attached to holed support members 20 adjacent the base of the outer wall 13 by means of screws 21. The support members 14, 16 and 20 are attached to rib members extending between the inner wall 12 and the outer wall 13 but are positioned adjacent the walls, as illustrated, in order to lend stability and flex-resistance to the game board. The playing surface board is attached to the frame 2 primarily adjacent the base of the inner wall 12 while the base board 19 is attached to the frame 2 primarily adjacent the base of the outer wall 13. This provides a zigzag attachment between boards 3 and 19 and frame 2 and results in a stable assembly resistant to horizontal flexing.

As shown by FIGS. 2 and 3, the bars 6 are adapted for telescoping movement over rods 22, the ends of which are retained in seats or slots 23 on one side member 4. The bars 6 are retained within larger seats or slots 24 on the other side member 4 by means of molded bushings 25 which fit into slots 24 and are held in place by the retainer strips 8. The bars 6 are provided with handles 26 and can be moved in and out within limits, defined by the engagement of inner and outer springs 27 with the frame, and can be rotated freely to pivot the simulated players 7 to engage the game piece and attempt to move it from the playing surface into thee opponent's goal, defined by openings 28 in the surface of the inner wall 12 of end members 5.

As illustrated by FIGS. 2, 3 and 4, the top surface 9 of the frame 2 comprises continuous longitudinal flat shoulders 9*a* and a plurality of spaced central raised channel elements 29 connected to the flat shoulders 9*a* and also to each other by plane elements 9*b*, elements 29 being aligned along surface 9 to provide a single discontinuous slot 30 for engagement with the flexible retainer strip 8. The flexible retainer strip 8, as shown in FIG. 5, has a semi-circular cross-section, diametrically opposed ribs 31 adapted to contact the continuous flat shoulders 9a of the top surface 9 of the frame 2 on each side of the central channel elements 29, and a single radial rib 32, the tip 33 of which preferably has a substantially triangular cross-section with vertex towards the center and a base wider than the thickness of rib 32, as illustrated by FIG. 5 of the drawings. The thick tip is adapted to be retained beneath the slot 30 of elements 29 when the flexible retainer strip 8 is fastened at the top surface 9 such as by slipping the radial rib 32 into the slot 30 and pushing the retainer strip 8 along the flat top surface until it covers the entire surface, the length of the strip 8 preferably being greater than the length of the surface 9 so that the ends of strip 8 extend into openings 5*a* and 5*c* in the end members 5 for a better appearance and to prevent the ends of the strips 8 from being lifted out of contact with surface 9 unless the strip 8 is slipped sufficiently into opening 5*a* that the other end of the strip 8 clears the opening 5*c*. The flexibility of strip 8 causes it to snap into position tightly against the flat shoulders 9*a* of surface 9, the engagement between cross-rib 33 of the strip 8 and the underside of elements 29 adjacent slot 30 preferably being such as to cause a downward strain on element 8 which forces the opposed ribs 31 into relatively tight engagement with the continuous shoulders 9*a* of top surface 9, as illustrated by FIGS. 2 and 3 of the drawings. The flexibility of strip 8 also permits removal of the strip whereby one end is grasped and lifted above the upper surface of end members 5 of the frame and slipped out of engagement with the channel elements 29.

According to a preferred embodiment, illustrated by FIG. 2, channel elements 29 and 29*a* are so positioned and so designed on the top surfaces 9 of each of the side members 4 that the flexible retainer strips 8 can only be inserted from one direction. Thus each side member 4 has one channel element 29a on the top surface 9 thereof spaced from one end member 5, and these channel elements 29*a* have a slot which is wider than slot 30 of the other channel elements 29 and is greater than the cross width of tip 33 of rib 32 of retainer strip 8. This permits the flexible retainer strip 8 to be longitudinally introduced or removed only from one direction, i.e. from the end of each side member 4 carrying the wider channel element 29*a*, since the wider slot of channel element 29*a* and the spacing of channel element 29*a* from end member 5 permits the flexible retainer strip 8 to be lifted radially out of the slot of channel element 29*a* and bent sufficiently to overcome the level difference between the top surface of end member 5 and the top surface 9 of side members 4. The retainer strip 8 is of sufficient length that when it is applied and one end is slipped into opening 5*a* in end member 5 into contact with retainer 5*b* therein, the opposite end of the retainer strip 8 clears the opposite end member 5 so that the strip 8 lies flat on shoulders 9*a* of top surface 9. Then the retainer strip 8 can be slipped back so that said opposite end enters opening 5*c* of opposite end member 5 until it contacts retainer 5*d* therein. At this position each end of the retainer strip 8 is within its respective opening 5*a* and 5*c* so that the strip 8 is tightly engaged in place. Furthermore the fact that retainer 5*b* is positioned twice as deep in opening 5*a* as retainer 5*d* is positioned within opening 5*c* permits the retainer strip 8 to be removed from only one direction, i.e. by slipping the strip 8 into opening 5*a* as far as it will go and then lifting the opposite end of the strip 8 which is out of engagement with its opening 5*c* and is clear of its end member 5.

The system of introduction and removal of the flexible strip discussed supra is to be preferred in case of repair of the game, while assembly on an industrial scale is preferably radial and is carried out by pushing tip 33 of rib 32 into the discontinuous slot 30 and by slipping at the same time one end of the flexible strip 8 into opening 5*a* against element 5*b*. A further slipping in the opposite direction against element 5*d* will engage the other end of the flexible strip within opening 5*c*. Such radial insertion of the retainer strip is possible because of the flexibility of the channel elements 29, the triangular cross-sectional shape of the tip 33 of rib 32 of the retainer strip 8, as shown by FIG. 5, and the inwardly tapered surfaces of the channel elements 29 forming slots 30, as shown by FIG. 4.

As is clear from the drawings, when retainer strip 8 is removed from top surface 9, the slots 23 and 24 are open so that the game piece-activating bars 6 including rods 22 and bushings 25 can be freely removed for repair, replacement or other purposes. Conversely, when the retainer strips 8 are locked in engagement with the channel elements 29, the bushings 25 are also engaged by the underside of the ribs 31 of the retainer strips and retained tightly in their slots 24 while rod end slots 23 are also closed by the retainer strips 8 preventing the end of the rods 22 from being lifted out of the slots 23.

FIGS. 2 and 6 of the drawings also illustrate the presence of cylindrical leg-engaging wells 34 within the walls of the end members 5 of the frame 2, and cylindrical legs 35 which frictionally engage the inner surface of wells 34 when the game board is used with the legs in position as supporting elements. The legs are removable and the game board can be used directly on a floor or table top.

FIG. 6 illustrates a section of the undersurface of the base board 19 with an opening permitting the leg well 34 to extend therethrough. The base board screws 21 are exposed while the playing surface board 3 and the screws 15 and 17 which fix board 3 to the frame 2 are concealed beneath the base board 19, as shown by broken lines.

As shown in FIGS. 1 and 2, the inner and outer walls 12 and 13 of the end members 5 of the frame provide a housing for the inclined ball return element 10 which receives the game ball from the playing surface through opening 28 in the inner wall 12 and delivers it beyond the outer wall 13 through openings 36 therein. This housing also contains a manually-rotatable score dial 11 which carries a progression of numbers and can be rotated to indicate the correct score. Finally, this housing also contains the leg wells 34. Thus it can be seen that the spaced inner and outer walls of the frame 2 provide functional utility as well as structural strength and streamlined appearance.

The housing also provides a novel means for retaining the game piece-activating bars 6 securely in place and yet easily removable. It is known to employ inverted U-shaped flexible plastic strips to retain bars of this type in soccer games having wooden frames. However such strips have two longitudinal radial leg projections which are engaged by opposed longitudinal slots along substantially the entire length of each wooden side of the frame so that the slots must be open at one end of each side and the retainer strip must be slipped straight into the slots to form the top retainer element of each side. Obviously such a construction permits the strip to slip from the top of the wooden side too easily unless a screw or other means is used to secure it in place. The present construction provides a retainer strip 8 having a single central engaging rib 33 which is engaged within a single discontinuous slot 30 on top of each side member 4 of the housing, which permits the strips 8 to be applied radially during assembly of the game, and to be flexed during insertion and during removal of strips 8 from the housing for repair of the game. Thus no separate means are required to secure the strips in place.

In games where no game piece-activating bars such has 6 are employed, the top surface of the side members of the frame can be molded as a continuous flat or rounded surface, free of openings such as 23 and 24 and no removable retainer strip is required.

Variations and modifications may be made within the scope of the claims and portions of the improvements may be used without others.

I claim:

1. A game board adapted for use with a movable game piece comprising a playing surface board, a generally rectangular unitary plastic frame having opposed side sections and opposed end sections providing a walled element around said playing field board for substantially confining the game piece thereon, said plastic frame having a generally inverted U-shaped cross-section and comprising downwardly spaced inner and outer walls connected by a top surface, the base of said inner wall generally defining a rectangle and being connected adjacent the base to said playing field board whereby said inner wall extends above said playing field board to provide a walled element around said playing field board for substantially confining the game piece thereon, and the base of said outer wall extending below the base of said inner wall and generally defining a larger rectangle and being connected adjacent the base to a base board which extends on a plane beneath the playing field board and serves as the bottom cover for the game board, the base of the inner wall of each of said side sections being longitudinally inclined from each end section downwardly to the center of each side section whereby the attachment of said playing field board adjacent the base of said inner wall causes said playing field board to be inclined downwardly from each end section to the center of each side section, such inclination adapted to cause a free moving game piece to move to the center of the surface of the playing field board and said inner wall being downwardly and inwardly inclined, adjacent its base, to the surface of the playing field board in order to increase the area of contact playing field board and to provide means for deflecting the game piece during play.

2. A game board according to claim 1 in which the top surface of opposed side sections of said frame is provided with transverse openings comprising bushings adapted to slidably retain rotatable striking members adapted to move said game piece, and with means on said top surface for engagement with a removable strip which covers said transverse openings and restricts removal of said striking members.

3. A game board according to claim 2 in which said removable strip comprises a flexible elongate plastic strip having an inverted, generally semi-circular cross-section and having on the underside thereof a longitudinal radial rib having a greater thickness adjacent the tip thereof, and diametrically opposed longitudinal ribs, one on each side of said radial rib, to contact the opposed edges of the top surface of said side sections, the means on the top surface of the opposed side sections of the frame for engagement with the removable strip comprises a discontinuous slot into which said radial rib is slipped and in which said strip is retained by engagement of the thick tip of said radial rib with the underside of said engagement means adjacent said discontinuous slot, the flexibility of the plastic strip being such that the engagement of the tip of the radial rib with the underside of the engagement means and the engagement of said opposed longitudinal ribs with the edges of the top surface provides a downward strain upon the flexible elongate plastic strip.

4. A game board according to claim 3 in which opposed barriers are present at each end of the top surface of the side members of the frame to prevent the flexible plastic strip from being removed while it is in flat engaged position, and each of said discontinuous slots has a void adjacent one of said barriers to permit the flexible plastic strips to be removed by lifting and flexing one end out of said void and then pulling said strips out of engagement with said engagement means.

5. A game board according to claim 1 in which the inner wall is provided with openings at the opposed end sections of the frame to admit the game piece from the playing surface.

6. A game board according to claim 1 in which the spaced inner and outer walls at the opposed end sections of the frame comprise a housing containing means for receiving the game piece from the playing surface through an opening in the inner wall and for delivering the game piece from the housing through an opening in the outer wall.

7. A game board according to claim 1 in which the spaced inner and outer walls of the frame comprise a housing for a score dial which is rotatably mounted in said housing and is visible through an opening provided in said housing.

8. A game board according to claim 1 in which the frame is provided with leg-receiving sockets between said spaced inner and outer walls and said base board is provided with openings to permit the insertion of game board-supporting legs into said sockets.

* * * * *

UNITED STATES PATENT OFFICE

CERTIFICATE OF CORRECTION

PATENT NO. : 3,931,970

DATED : January 13, 1976

INVENTOR(S) : Claudio Cecchetti

It is certified that error appears in the above-identified patent and that said Letters Patent are hereby corrected as shown below:

Column 2, line 55, "thee" should be --the--; column 5, line 12, "has" should be --as--; column 5, line 51 (Claim 1), after "contact" insert --between the base of the inner wall and the surface of the--.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*